United States Patent [19]

Ruger

[11] Patent Number: 4,815,226

[45] Date of Patent: Mar. 28, 1989

[54] RIFLE FLOOR PLATE LATCH

[75] Inventor: William B. Ruger, Croydon, N.H.

[73] Assignee: Sturm, Ruger & Company, Inc., Southport, Conn.

[21] Appl. No.: 140,273

[22] Filed: Dec. 31, 1987

[51] Int. Cl.[4] ..... F41C 25/02
[52] U.S. Cl. ..... 42/6
[58] Field of Search ..... 42/6, 18, 22

[56] References Cited

U.S. PATENT DOCUMENTS 2,745,203 5/1956 Ruple ..... 42/6
3,415,000 12/1968 Koucky et al. ..... 42/18
4,450,641 5/1984 Bullis et al. ..... 42/6

FOREIGN PATENT DOCUMENTS 277814 1/1970 Austria ..... 42/6

*Primary Examiner*—Charles T. Jordan
*Attorney, Agent, or Firm*—Pennie & Edmonds

[57] ABSTRACT

A magazine floor plate latch mechanism including a lever pivotally mounted in the trigger guard which lever is sized, shaped and housed so that it cannot be actuated from within the trigger guard. The lever protrudes from an exit located in the front of the trigger guard a sufficient distance to be actuable from the front of the guard to accomplish arcuate lever rotation to release the floor plate. Preferably, the lever does not protrude past the front of the trigger guard, thereby precluding inadvertent operation by a foreign object striking the front of the trigger guard.

2 Claims, 1 Drawing Sheet

RIFLE FLOOR PLATE LATCH

BACKGROUND OF THE INVENTION

Latches for releaseably holding a magazine floor plate in a rifle have included push button arrangements (U.S. Pat. No. 2,745,203) and latches mounted in the trigger guard (U.S. Pat. No. 4,450,641).

Trigger guard mounted floor plate latch mechanisms have had the disadvantage that during operation of the firearm the trigger finger located in the trigger guard could cause the floor plate to open inadvertently. This can also happen when the firearm recoils rearward at the moment of firing, if the latch is located where it is subject to accidental release, or if it operates in a direction so that recoil tends to unlatch the magazine floor plate. Latches mounted outside the trigger guard have heretofore been subject to inducement activation by external objects such as twigs, branches, etc.

SUMMARY OF THE INVENTION

Broadly, the present invention comprises a pivotal latch mounted within the trigger guard and not protruding into the interior of the guard which latch can therefore only be operated from the exterior of the guard.

It is a feature of the invention that the hand operable portion of the latch mechanism is located within a trigger guard frame recess to make less likely inadvertent operation.

It is a further feature of the invention that its latching of the floor plate becomes more secure during recoil of the firearm.

DESCRIPTION OF THE PREFERRED EMBODIMENT

Figure 1:
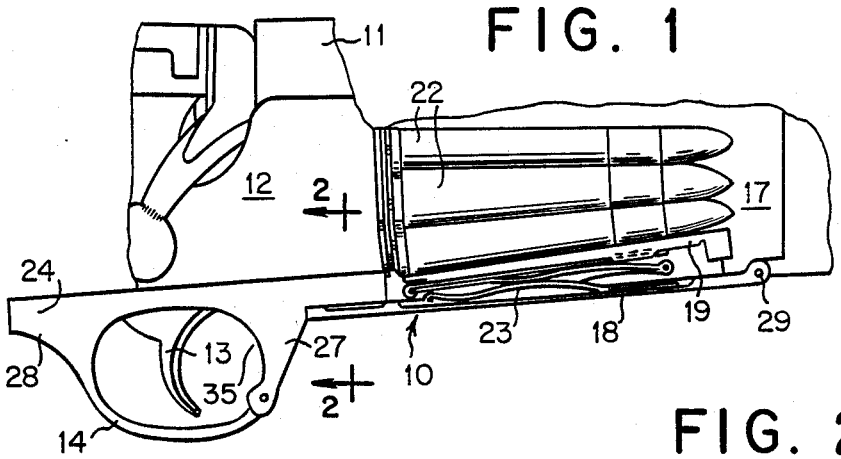
FIG. 1 is a partial elevational view showing a rifle trigger guard with housed latch mechanism, magazine and floor plate.

In the Figures, rifle 10 includes receiver 11, stock 12, trigger 13 and trigger guard 14. Located forward of the trigger guard 14 is cartridge magazine receptacle 17 (which is an integral part of the receiver 11), hinged magazine floor plate 18, magazine cartridge lifter 19, spring 23 and cartridges 22. Magazine cartridge lifter 19 is urged upwardly by spring 23. Trigger guard 14 includes frame portion 24 and forward and rearward curved housing portions 27 and 28 respectively. Floor plate 18, as hinged at pivot pin 29, is held closed by releasable latch mechanism 31 which is finger-operated to release floor plate 18 to remove or replenish cartridges 22.

The plate latch mechanism 31 includes a pivotal activating lever 32 pivotal about pin 33 mounted in forward trigger guard portion 27. Lever 32 positioned in trigger guard cavity 34 includes an upper portion 38 having an indentation **38*a* in which one end of return spring 40 is housed. Spring 40 urges lever 32 clockwise about pin 33 with portion 38 abutting cavity wall 34*a* in the normal latched position. Lever 32 is shaped and configured to nest in cavity 34 (which cavity is positioned in both forward trigger guard housing portion 27 and plate frame portion 24) so that lever 32 is not actuable by movement of the operator's finger when his or her finger is within trigger guard 14. This is accomplished by providing a rearward lever surface 36 which does not protrude past (and for appearance purposes generally conforms with) the forward interior profile surface 35 of trigger guard 14. Since lever surface 36 does not project into the interior of the guard 14, lever 32 cannot be turned clockwise about pivot pin 33 by operator hand movement. In like manner, lever 32 does not protrude past the outside front edges of trigger housing 27, so that objects external to the rifle cannot readily inadvertently depress lever 32 and so empty the magazine when it is not desired to do so. The forward guard housing 27 has a finger-receiving recess 37 which permits lever 32 to be pushed in the rearward counterclockwise direction against return spring 40. Recess 37 has an exit 37*a* leading into cavity 34. Lever 32 also carries ledge 41 on its forward side just below portion 38 which ledge 41 supports the rearward extension 42 of floor plate 18 to hold the plate 18** in its closed position.

Figure 2:
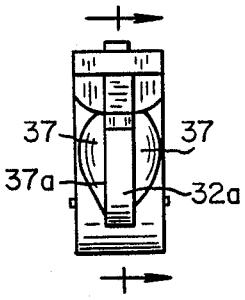
FIG. 2 is a sectional view taken along line 2—2 of FIG. 1.
Figure 3:
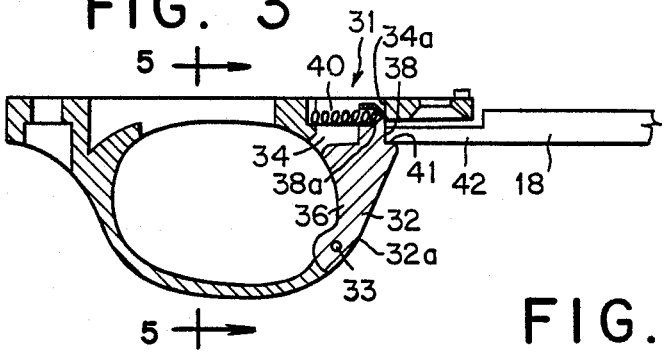
FIG. 3 is an enlarged sectional view taken along line 3—3 of FIG. 2.
Figure 5:
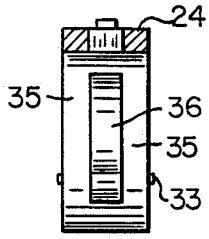
FIG. 5 is a sectional view taken along line 5—5 of FIG. 3.
Figure 4:
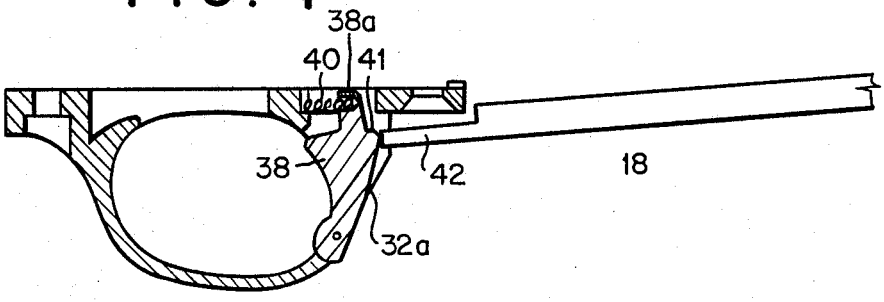
FIG. 4 similar view to FIG. 3 with the latch actuated to release the floor plate.

In operation of the latch mechanism 31, lever 32 is pressed rearward by finger action. As pressure is applied and lever 32 moves the operator's finger will normally enter recess 37. Further lever 32 movement results in extension 42 clearing ledge 41 and the release of the extension 42 permitting pivotal floor plate 18 to swing to an open position. Recess 37 is shaped and configured to permit finger or thumb access to pivot lever 32 to move lever 32 through an arc of sufficient length to position ledge 41 rearward a sufficient distance to clear and release floor plate extension 42 (See FIG. 4). Recess 37 is generally concave with its maximum depth located at about its maximum width as viewed in FIG. 2. The recess depth is about one-half the thickness of guard 14 at that location. Once cartridges 22 have been loaded or unloaded, floor plate 18 is swung back up against front profile surface **32*a* of lever 32 to cause lever 32 to rotate counterclockwise against spring 40 until extension 42 rests on and is supported by lever ledge 41 holding plate 18** in a closed position.

Alternatively, recess 37 can be made smaller or eliminated provided lever 32 is sized and configured to protrude from recess exit **37*a* a sufficient distance to permit lever 32 rotation through the required arc by the operator's hand to accomplish release of floor plate 18**.

I claim:

1. In a firearm having a cartridge containing magazine and a floor plate mounted at a forward pivotal point and forming a part of such magazine, a latch mechanism for releaseably holding said plate in position comprising a trigger guard positioned rearwardly of the floor plate having a forward housing section, said trigger guard having an internal profile surface;

a cavity in the forward housing section of the trigger guard, which cavity extends from the internal profile surface of the guard to the forward part of the forward housing section where the cavity includes a forward cavity exit; and a lever engageable with the floor plate and having a forward profile surface and a rearward profile surface pivotally housed in said recess, the rearward profile surface not extending into the interior trigger guard profile and the forward profile surface positioned so that it can be actuated by hand or otherwise to rotate the lever a sufficient distance to unlatch the floor plate.

2. The latch mechanism of claim 1 in which the forward housing has a recess to facilitate lever rotation.

* * * * *